US007195120B2

(12) United States Patent
Cunningham et al.

(10) Patent No.: US 7,195,120 B2
(45) Date of Patent: Mar. 27, 2007

(54) TOOL BIT STORAGE AND DISPLAY CONTAINER

(75) Inventors: Ian W. Cunningham, Matthews, NC (US); Jon S. Holz, Huntersville, NC (US); Craig S. Roberts, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 430 days.

(21) Appl. No.: 10/618,395

(22) Filed: Jul. 11, 2003

(65) Prior Publication Data

US 2004/0217032 A1 Nov. 4, 2004

Related U.S. Application Data

(63) Continuation-in-part of application No. 29/180,850, filed on Apr. 30, 2003, now Pat. No. Des. 505,068.

(51) Int. Cl.
*B65D 73/00* (2006.01)

(52) U.S. Cl. ..... 206/461; 206/349

(58) Field of Classification Search ..... 206/461, 206/349, 806; 220/480, 481, 483
See application file for complete search history.

(56) References Cited

U.S. PATENT DOCUMENTS

| | | | | |
|---|---|---|---|---|
| 2,717,717 | A * | 9/1955 | Busch | 220/483 |
| 3,023,925 | A | 3/1962 | Sher | 220/60 |
| 3,082,902 | A | 3/1963 | Kimbrough, Jr. | 220/18 |
| 3,171,565 | A | 3/1965 | Nozette | 220/18 |
| 3,408,758 | A | 11/1968 | Doring | 40/124.1 |
| 3,575,285 | A | 4/1971 | Kahn | 206/44 |
| 3,695,418 | A * | 10/1972 | Gwozdz | 206/770 |
| 4,166,553 | A | 9/1979 | Fraterrigo | 222/181 |
| 4,375,850 | A | 3/1983 | Smyth et al. | |
| 4,632,242 | A | 12/1986 | Choi et al. | 206/45.34 |
| 4,634,005 | A | 1/1987 | Kulzer et al. | 206/477 |
| 4,703,852 | A | 11/1987 | Verdier | |
| 4,739,883 | A | 4/1988 | Mohs et al. | |
| 4,955,478 | A | 9/1990 | Rau et al. | |
| 4,958,732 | A | 9/1990 | Rau et al. | |
| D313,889 | S | 1/1991 | Gakhar et al. | |

(Continued)

FOREIGN PATENT DOCUMENTS

| | | |
|---|---|---|
| GB | 2335846 | 10/1999 |

(Continued)

OTHER PUBLICATIONS

Photograph of box (2 pages, 7 photographs) believed to be on sale prior to the filing of the application.

(Continued)

*Primary Examiner*—David T. Fidei
(74) *Attorney, Agent, or Firm*—Dennis J. Williamson; Moore & Van Allen PLLC

(57) ABSTRACT

A product storage and display container and a method of displaying a product storage and display container are provided. The container includes a receptacle having a compartment adapted to house a product, a display tag, an engagement element formed on one of the tag and the receptacle, a receiving element formed on the other of the tag and the receptacle, wherein the mating of the engagement element with the receiving element retains the display tag on the receptacle.

26 Claims, 7 Drawing Sheets

U.S. PATENT DOCUMENTS

| | | | | |
|---|---|---|---|---|
| D320,124 | S | | 9/1991 | Gakhar et al. |
| 5,044,773 | A | * | 9/1991 | Harms et al. ..... 383/22 |
| 5,050,760 | A | * | 9/1991 | Garcia ..... 220/751 |
| 5,071,005 | A | | 12/1991 | Hemmings et al. |
| 5,108,287 | A | | 4/1992 | Yee et al. |
| 5,137,209 | A | * | 8/1992 | Roberts et al. ..... 229/117.25 |
| 5,279,420 | A | | 1/1994 | Rodgers ..... 206/446 |
| 5,425,519 | A | | 6/1995 | Budert ..... 248/214 |
| 5,509,528 | A | * | 4/1996 | Weisburn ..... 206/45.24 |
| 5,897,001 | A | | 4/1999 | Dembicks ..... 211/70.6 |
| 5,941,019 | A | | 8/1999 | Guarriello et al. ..... 47/66.6 |
| 5,979,649 | A | | 11/1999 | Rosler ..... 206/379 |
| D418,678 | S | | 1/2000 | Robson |
| D418,977 | S | | 1/2000 | Streich |
| 6,053,675 | A | | 4/2000 | Holland et al. |
| 6,082,538 | A | | 7/2000 | Snider et al. |
| 6,082,573 | A | * | 7/2000 | Hofman et al. ..... 220/480 |
| 6,092,656 | A | | 7/2000 | Ernst ..... 206/378 |
| D437,684 | S | | 2/2001 | Streich et al. |
| 6,213,296 | B1 | | 4/2001 | Streich et al. |
| 6,273,255 | B1 | | 8/2001 | Rosler ..... 206/378 |
| D447,340 | S | | 9/2001 | Snider |
| D447,630 | S | | 9/2001 | Snider |
| 6,283,311 | B1 | | 9/2001 | Lee ..... 211/70.6 |
| D448,564 | S | | 10/2001 | Snider |
| D449,442 | S | | 10/2001 | Snider |
| D449,518 | S | | 10/2001 | Snider et al. |
| D449,738 | S | | 10/2001 | Snider et al. |
| D449,931 | S | | 11/2001 | Snider |
| 6,405,864 | B1 | | 6/2002 | Streich et al. |
| 6,409,015 | B1 | | 6/2002 | Hu ..... 206/378 |
| D462,520 | S | | 9/2002 | Snider |
| D467,078 | S | | 12/2002 | Snider |
| D472,464 | S | | 4/2003 | Snider |
| 6,808,090 | B2 | * | 10/2004 | Pedersen ..... 222/181.3 |
| 2002/0027092 | A1 | | 3/2002 | Hu ..... 206/378 |

FOREIGN PATENT DOCUMENTS

| | | |
|---|---|---|
| JP | 8230887 | 9/1996 |

OTHER PUBLICATIONS

Photograph of box (3 pages, 5 photographs) believed to be on sale prior to the filing of the application.

Combined Search and Examination Report, Aug. 10, 2004 for Application No. GB0408441.4.

* cited by examiner

TOOL BIT STORAGE AND DISPLAY CONTAINER

This application is a continuation-in-part of U.S. design application Ser. No. 29/180,850, filed Apr. 30, 2003, now U.S. Pat. No. D,505,068 the entirety of which is incorporated herein.

BACKGROUND OF THE INVENTION

The present invention relates to a container. In particular, the present invention relates to a storage and display container for loose tool bits having a flip-top opening and a rotatable hang tag.

Various types of display packaging exist for displaying groups or sets of tool accessories. The packages may be displayed efficiently as stacked containers on shelves or suspended from hooks on display racks. A salable container holding lightweight, smaller items may be suspended from a hook on a display rack. Typically in these containers, a cardboard or plastic hang tag is rigidly fixed to the container or is fixedly secured to the container via shrink wrap packaging.

These types of packaging used for displaying small lots of items on display racks have several disadvantages. For example, a flexible plastic strip or fixed-position plastic hang tag may be broken or torn off during shipping, thereby preventing the package from being displayed in the intended fashion. Furthermore, to prevent theft, many small items are packaged for sale in containers or packages that are large in relation to the items contained therein. The larger packages are not efficient for the consumer to store in limited space, for example, in a tool box. In addition, the larger packages require larger mounting cards, etc. While larger packages are sometimes used, the larger packages are wasteful and attachment of a hang tag is more complex, requiring extra glue, more material, extra steps for assembly, etc. Some packages are solely designed for display of the items for sale and once opened, the purchaser can not use the sales package to store the purchased items.

Therefore, it is desirable to provide a display and storage container for loose tool items that enables the retailer to display the container, prevent theft of the container, and allow the purchaser to use the display package for efficient, reusable storage once the item is purchased and opened for use.

BRIEF SUMMARY OF THE INVENTION

The present invention provides a simple storage and display container, wherein the container allows for efficient retail display, prevents theft, and serves as a space-saving, reusable storage device for the end user.

According to one aspect of the present invention there is provided a product storage and display container. The container includes a receptacle having a compartment adapted to house a product, a display tag, an engagement element formed on one of the tag and the receptacle, and a receiving element formed on the other of the tag and the receptacle for receiving the engagement element. The mating of the engagement element with the receiving element retains the display tag on the receptacle.

In another aspect of the present invention, a method for displaying a product for sale is provided. The method includes the steps of providing a container having a receptacle defining a compartment adapted to house a product, the receptacle having one of an engagement element and a receiving element, providing a display tag having the other of the engagement element and the receiving element adapted to engage the receptacle, attaching the display tag to the receptacle via the engagement element and the receiving element, and hanging the container and the tag on a display.

In another aspect of the present invention, a product storage container is provided. The container includes a compartment adapted to house a plurality of products, a plurality of products housed in the container, and a display tag rotatably mounted to the container.

In another aspect of the present invention, a display tag is provided. The display tag includes a main tag body having a slot defined therethrough and an attachment means. The attachment means is adapted to engage an object and the display tag is rotatable relative to the object via the attachment means.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE INVENTION

Figure 1:
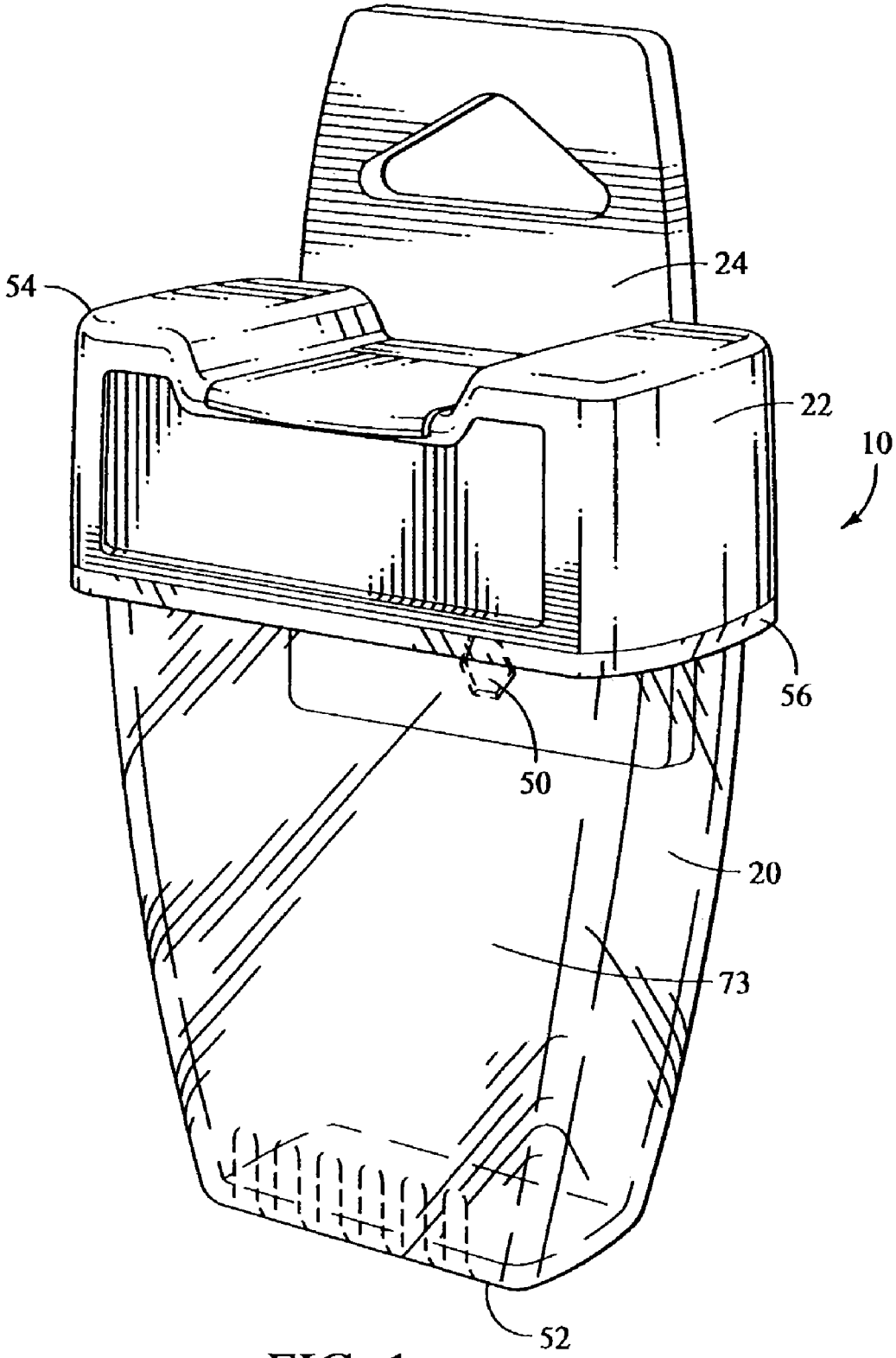
FIG. 1 shows a perspective view of a preferred embodiment of a container in accordance with the present invention.

FIG. 1 illustrates a preferred embodiment of a display and storage container 10 for loose tool bits of the present invention. The container 10 comprises a body 20, a lid 22 and a display tag 24.

Figure 2:
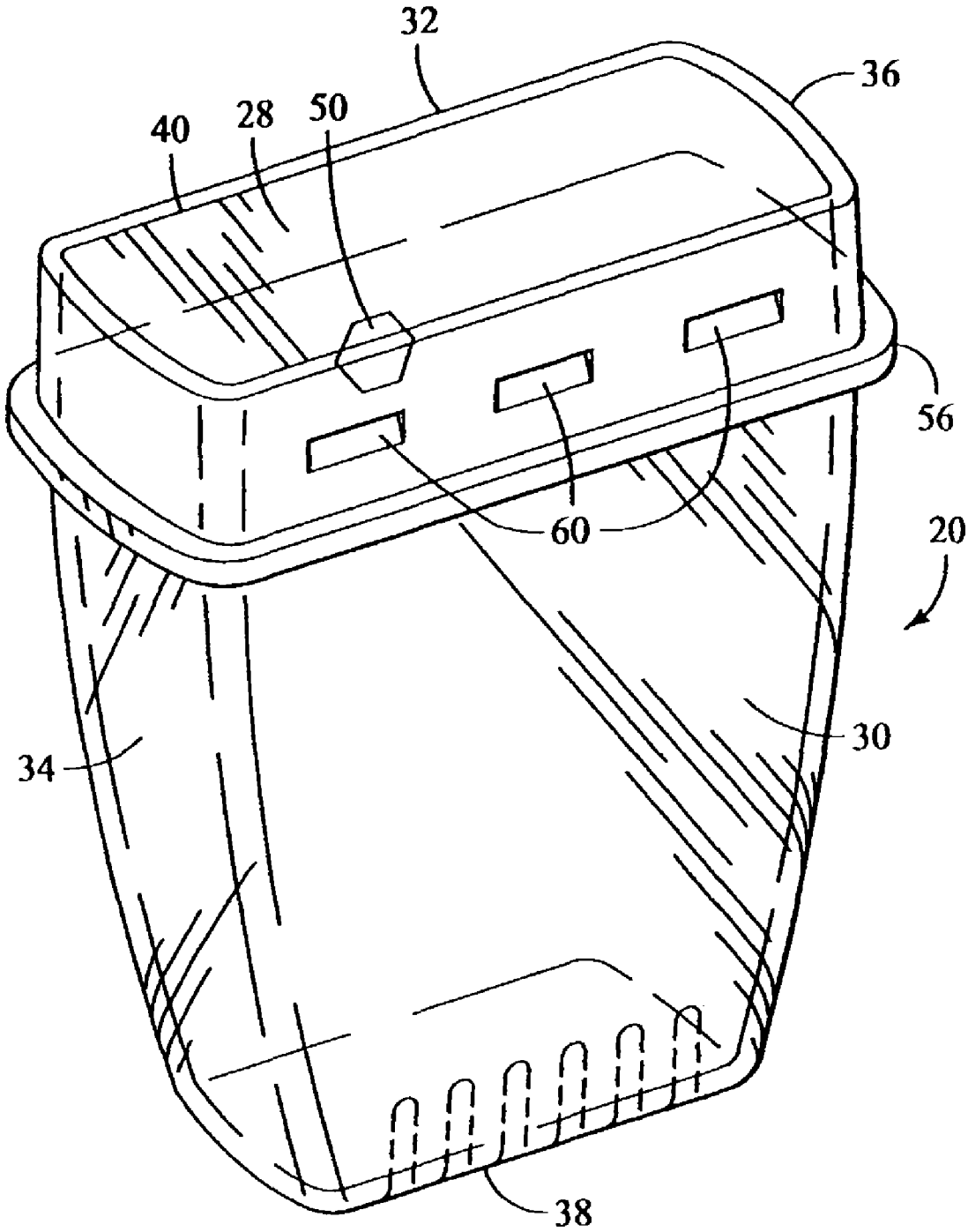
FIG. 2 shows a perspective view of the body of the container shown in FIG. 1 in accordance with the present invention.

The body 20 of the preferred embodiment is shown individually in FIG. 2. The body 20 comprises a substantially rectangular shaped compartment 28 adapted to house products, such as a plurality of loose tool bits. The compartment 28 within the body 20 is defined by a front wall 30, a back wall 32, side walls 34 and 36 and a bottom 38. The walls 30–36 and the bottom 38 are integrally joined to form the compartment 28 within the body 20. As shown in FIG. 2, the walls 30–36 define an opening 40 of the compartment 28 in the body 20. To create a more tapered shape, the compartment 28 may have a narrower bottom profile 52 with respect to an upper profile 54 at the opening 40 of the compartment 28. In addition, the side walls, 34 and 36, may be cambered and curved outwardly in the direction extending from the bottom 38 to the opening 40. While the walls are described herein as front, back and side, the present invention may assume various alternative orientations and shapes.

As shown in FIGS. 1 and 2, in the preferred embodiment, the back wall 32 further comprises a receiving element 50 formed there through. The receiving element 50 is adapted to engage a portion of the display tag 24.

The body 20 of the preferred embodiment further comprises a protruding ridge 56 formed integrally with the walls 30–36 and adapted to receive a lid 22 (discussed below). As shown in FIG. 2, the ridge 56 is continuous around the exterior of the body 20. However, the ridge 56 may be discontinuous, having protrusions on each wall 30–36 of the body 20, alternatively, the discontinuous protruding ridge may be on the front wall 30 and the back wall 32 or on the side walls 34 and 36.

The body 20 of the preferred embodiment comprises a plurality of rectangular, wedge-shaped recesses 60 formed in the front wall 30 and the back wall 32 (not shown). The recesses are formed in the walls 30 and 32 above the ridge 56 and below the opening 40 defined in the body 20. The plurality of recesses 60 may be formed in the side walls 34 and 36 as well as in the side walls 30 and 32 or, alternatively, in the side walls 34, 36 alone. The recesses may be in any shape adapted to receive protrusions from the lid 22 (described below). The protrusions on the lid 22 engage the recesses 60 in the body 20 and secure the lid 22 to the body 20.

Figure 3:
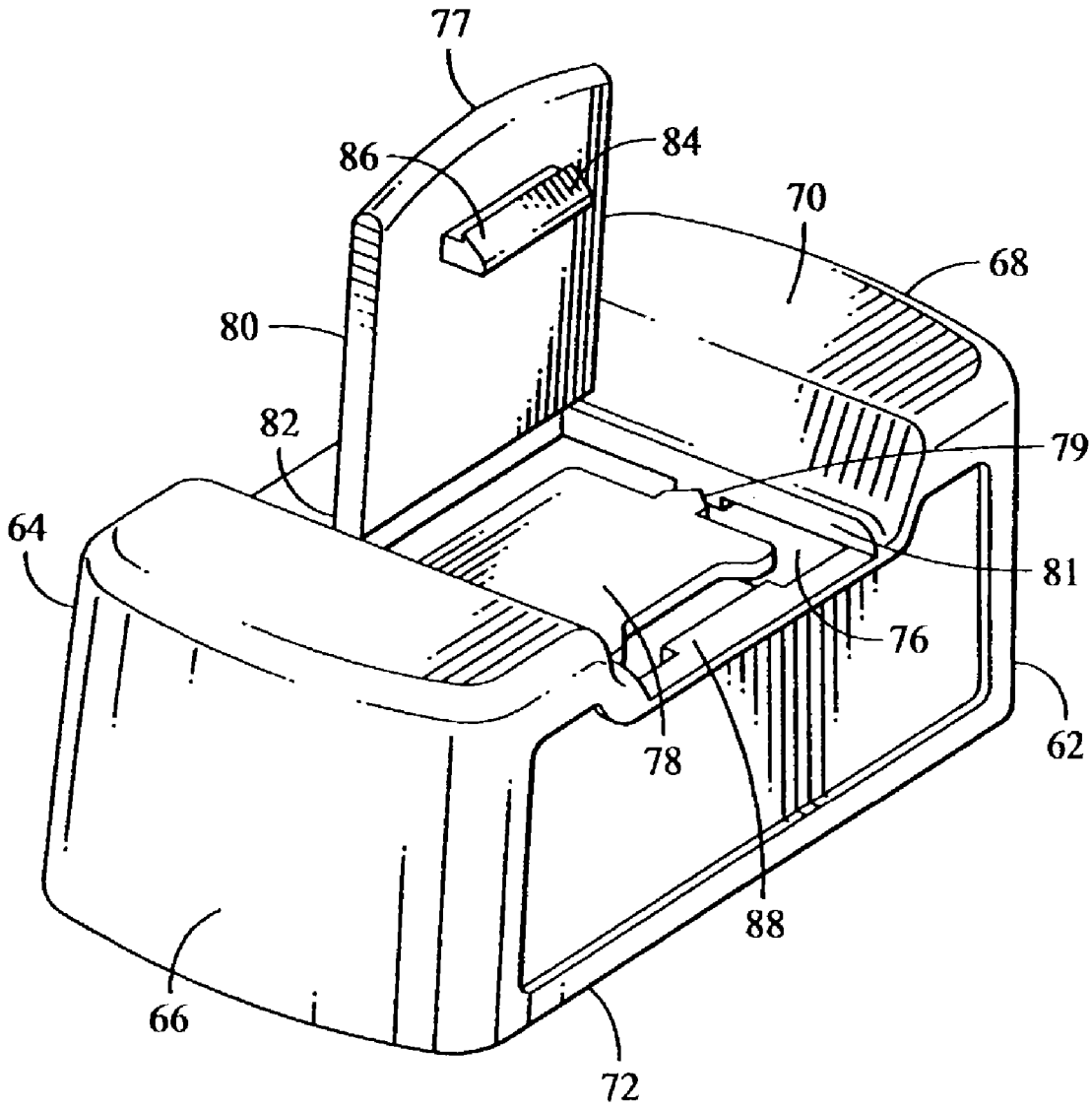
FIG. 3 shows a perspective view of the lid of the container shown in FIG. 1 in accordance with the present invention.

The lid 22 of the preferred embodiment of the present invention is shown in FIG. 3. The lid 22 comprises a front wall 62, a back wall 64, side walls 66 and 68 and a top 70 integrally joined to form the lid 22 and thereby defining an interior region 72.

The lid 22 is sized to correspond to the body 20 and is adapted to slidably engage the body 20 and cover the compartment 28. Together, the compartment 28 and the interior region 72 of the lid 22 form an enclosed receptacle 73 of the container 10 adapted for housing a product. The lid 22 is received on the body 20 wherein the lid 22 tightly engages the body 20 by sliding over the walls 30–36 that form the opening 40, thereby covering the opening 40. The lid 22 slides onto the body 20 until the lid 22 contacts the ridge 56 of the body 20.

The lid 22 further comprises a lid opening 76 in the preferred embodiment. As shown in FIG. 3, the lid opening 76 is recessed from the surface and located in the center of the top 70. A reclosable tab 80 is attached to the lid 22 by a living hinge 82 that is integrally formed with the tab 80 and the top 70. The living hinge 82 is preferably formed from the same material as the lid 22 having reduced thickness and sufficient elasticity to permit repeated bending without breaking.

The tab 80 is dimensioned to correspond to the lid opening 76 thereby covering the lid opening 76. The tab 80 further comprises an extension 77 that extends beyond the front wall 76 of the lid 22. The tab 80 is adapted to securely close the container 10. The extension flange 77 facilitates the opening and closing of the tab 80 with the thumb. The tab 80 further comprises a latching protrusion 84. The latching protrusion 84 is adapted to secure the tab 80 in the closed position. The latching protrusion 84 extends perpendicularly from the tab 80 and further comprises a hook extension 86 adapted to engage a lid protrusion 88 extending into the interior 72 from the front wall 62 of the lid 22. The lid protrusion 88 comprises a rectangular protrusion adapted to engage the hook 86. Other types of securing mechanisms may be used to secure the tab 80 in the closed position, thereby retaining the contents within the container 10.

The lid opening 76 further comprises an anti-theft covering 78. The covering 78 prevents the product housed in the container 10 from being removed from the container 10 before the container 10 is purchased. The covering 78 is recessed from the lid surface 70 at opening 76 and is adapted to provide coverage of the opening 76 sufficient to prevent removal of the product housed in the container 10 and yet allow the reclosable tab 80 to snap-lock and cover the opening 76. The covering 78 may be positioned below the tab 80 to prevent removal of the product if the tab 80 is opened before purchase. The cover 78 may be secured to the lid 22 by a plurality of molded attachment connections between the lid surface 81 defining the opening 76 and the cover 78. Once the container 10 is purchased, the anti-theft covering 78 may be detached from the plurality of molded connections, except for a pair of attachment connections on opposite sides of the opening 76. The cover 78 may also be rotated about the pair of attachment points 79 to allow the purchaser to remove the product. Alternatively, the anti-theft covering 78 may be completely removed by the purchaser. Any method, commonly known in the art, for attaching the cover 78 to the lid 22 may be used.

Figure 4:
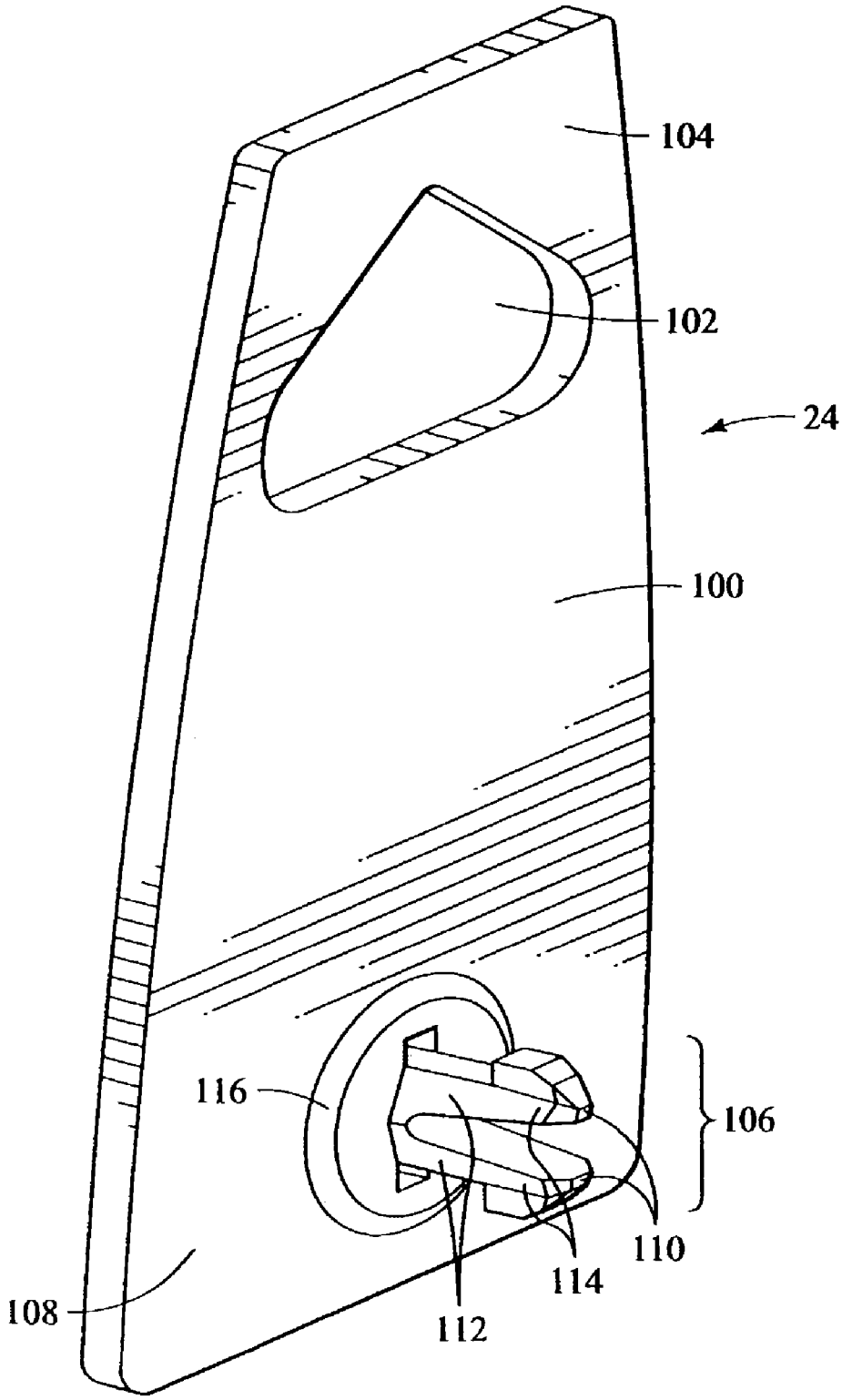
FIG. 4 shows a perspective view of the display tag of the container shown in FIG. 1 in accordance with the present invention.

FIG. 4 shows the hanging tag 24 of a preferred embodiment of the present invention. The tag 24 comprises a substantially planar main tag body 100 having a slot 102 defined there through at a first end 104 of the tag 24. The slot 102 is adapted to receive a display hook on a merchandising stand. Any configuration adapted to receive a display hook known in the art may be used with the present invention. The tag 24 further comprises an attachment means 105 at a second end 108 of the tag 24. The attachment means 105 may be an engagement element 106 or a receiving element 50 as described herein.

The contour of a preferred embodiment of the tag 24 substantially follows the contour of the back wall 32 of the body 20. However, the shape of the tag 24 may be any shape, and the tag 24 may also be non-planar. In a preferred embodiment, the tag 24 further comprises an engagement element 106 at the second end 108 of the tag 24. The engagement element 106 is adapted to engage the back wall 32 of the body 20 via the receiving element 50 formed through the wall 32.

As shown in FIG. 4, the engagement element 106 further comprises a pair of flexible, cantilevered hook members 110. The pair of hook members 110 are spaced apart and dimensioned to engage the wall 32 through the receiving element 50. Each hook member 110 extends substantially perpendicularly from the tag body 100. Each hook member 110 further comprises a rectangular member 112, each having a latching protrusion 114 extending outwardly therefrom. The hook members 110 are adapted to engage the wall 32 through the receiving element 50 thereby flexing together to pass through the receiving element 50 and expanding once the protrusions 114 have passed through the receiving element 50 in the wall 32 in order to engage the tag 24. Note that other engagement structures may also be implemented, including other snap-detachable structures, projecting members, swivel structures and others.

Figure 5:
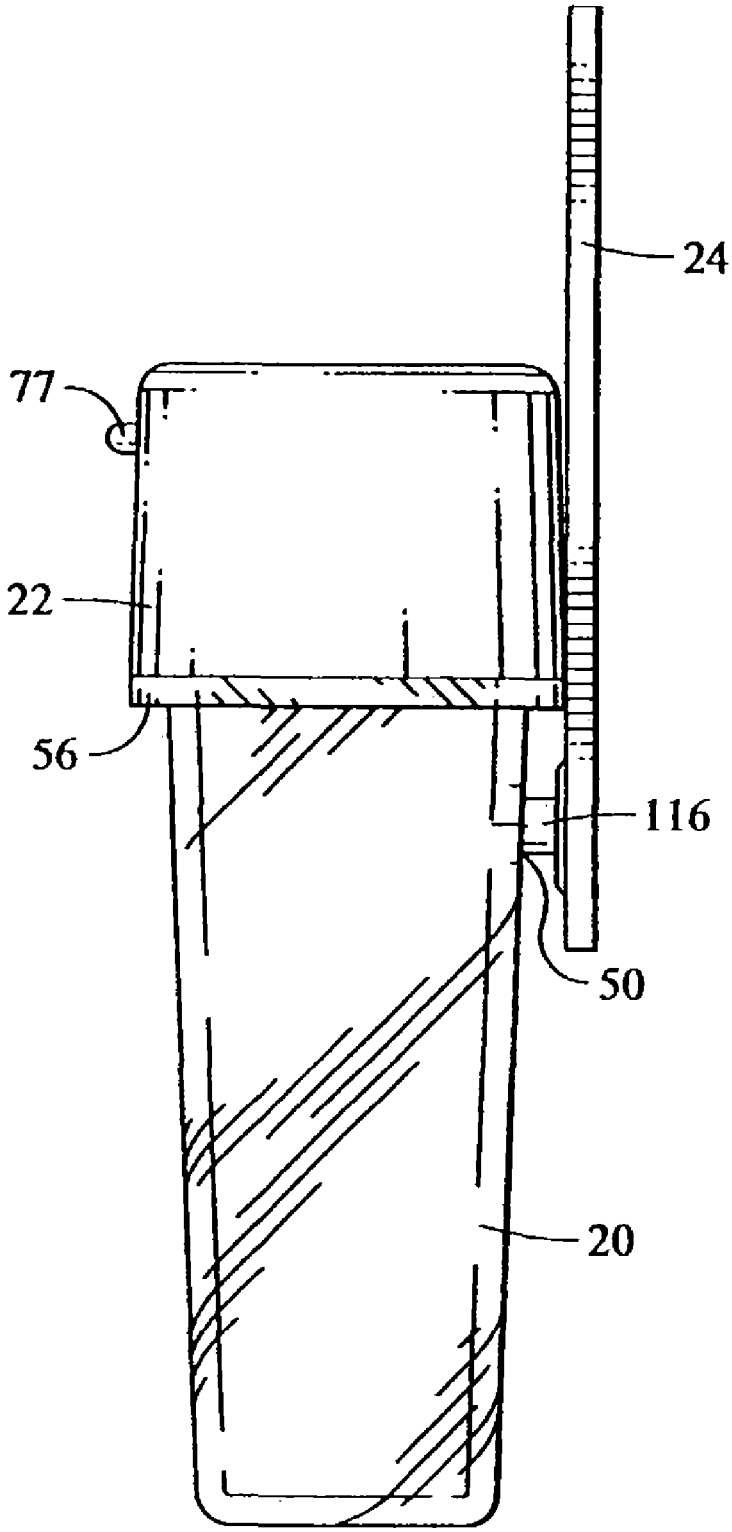
FIG. 5 shows a side view of the container in accordance with the present invention.

As shown in FIGS. 4 and 5, the tag 24 further comprises a raised annular ring 116 that surrounds the engagement element 106. The ring 116 may be dimensioned to provide clearance for the tag 24 to be able to rotate 360° about the engagement element 106 without the lid 22 or the ridge 56 impeding the rotation of the tag 24.

As shown in FIG. 5, the engagement element 106 is adapted to allow the tag 24 to be rotatable when the tag 24 is engaged with the body 20. The ring 116 surrounding the engagement element 106 provides clearance for the tag 24, when engagement element 106 is engaged through the receiving element 50. The ring 116 is adapted to extend the tag 24 from the body 20 past the ridge 56 of the body 20 and the lid 22. As shown in FIG. 5, the ring 116 is so dimensioned to provide clearance to allow the tag 24 to rotate 360° without interference from the tapered wall 32 wherein the upper profile 54 of the body 20 extends outward further than the bottom profile 52. In addition, the ring 116 may be so dimensioned to provide clearance so that the tag 24 tightly abuts the lid 22 when the first end 104 of the tag 24 is extended upward. The plane of the tag 24 remains substantially parallel to the plane of the back wall 32 while the tag 24 rotates on engagement element 106. The engagement element 106 may be dimensioned to allow the tag 24 to rotate and also to allow the engagement element 106 to tightly hold the tag 24 against the ridge 56 and the lid 22 to maintain the tag 24 in a position for display wherein the slot 102 is accessible to a display hook on a merchandising device. When the container 10 is not on display, for example, during shipment or after purchase, the tag 24 may be rotated such that the first end 104 of the tag 24 may be aligned with the bottom portion 38 of the body 20. After purchase, the tag 24 may be removed by the purchaser without destroying the container 10, thus allowing the purchaser to continue to, use the container 10 for storage of the product housed in the enclosed interior 73. Removing the tag 24 or rotating the tag 24 to be aligned with the bottom portion 38 of the body 20 provides a space-saving, more efficient, reusable storage container In alternative embodiments, the engagement element 106 may be formed on the receptacle 73 and the receiving element 50 may be formed on the tag 24. Additionally, the engagement element 106 may formed on any wall of the receptacle 73. When the engagement element 106 is formed on the tag 24, the receiving element may be formed on any wall of the receptacle 73. The engagement element 106 or the receiving element may be formed on the lid 22 or the body 20 that form the enclosed receptacle 73 of the container 10.

Figure 6:
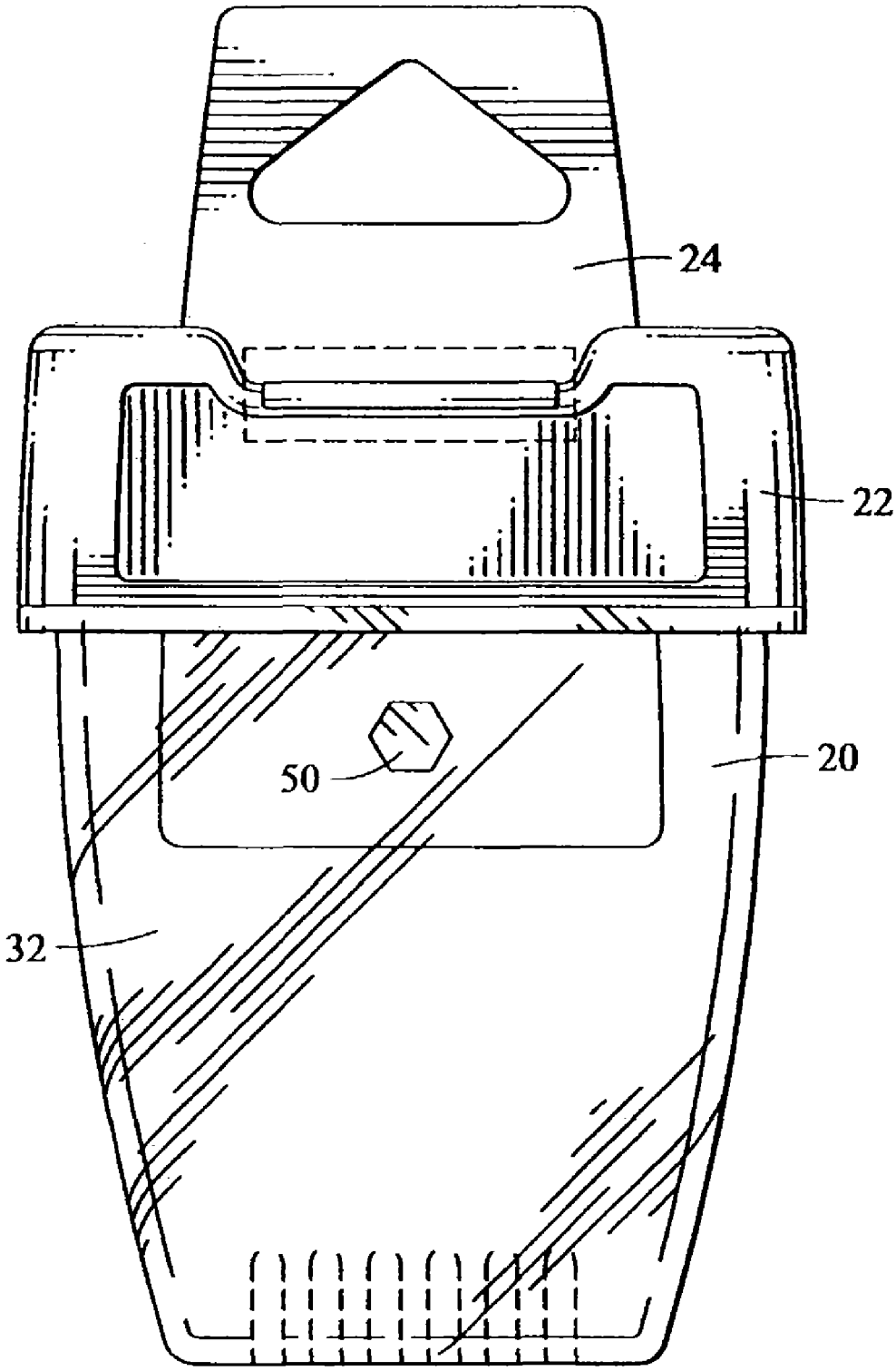
FIG. 6 shows a rear view of the container in accordance with the present invention.

The tag 24 as shown in FIGS. 1, 5, and 6 is engaged with the body 20. However, it should be noted that the tag 24 may also be adapted to be engaged with any type of package or object and be rotatable about the package or object. The tag 24 may include the receiving element 50 or the engagement element 106 when the tag 24 is adapted to engage the object, the object having the other of the receiving element 50 or the engagement element 106.

FIG. 6 shows back of the container 10 with the display tag 24 shown in phantom. The tag 24 is engaged in the back wall 32 of the body 20 in the receiving element 50 formed through the wall 32. The tag 24 is shown in the display position wherein the slot 102 may be engaged by a display hook.

Figure 7:
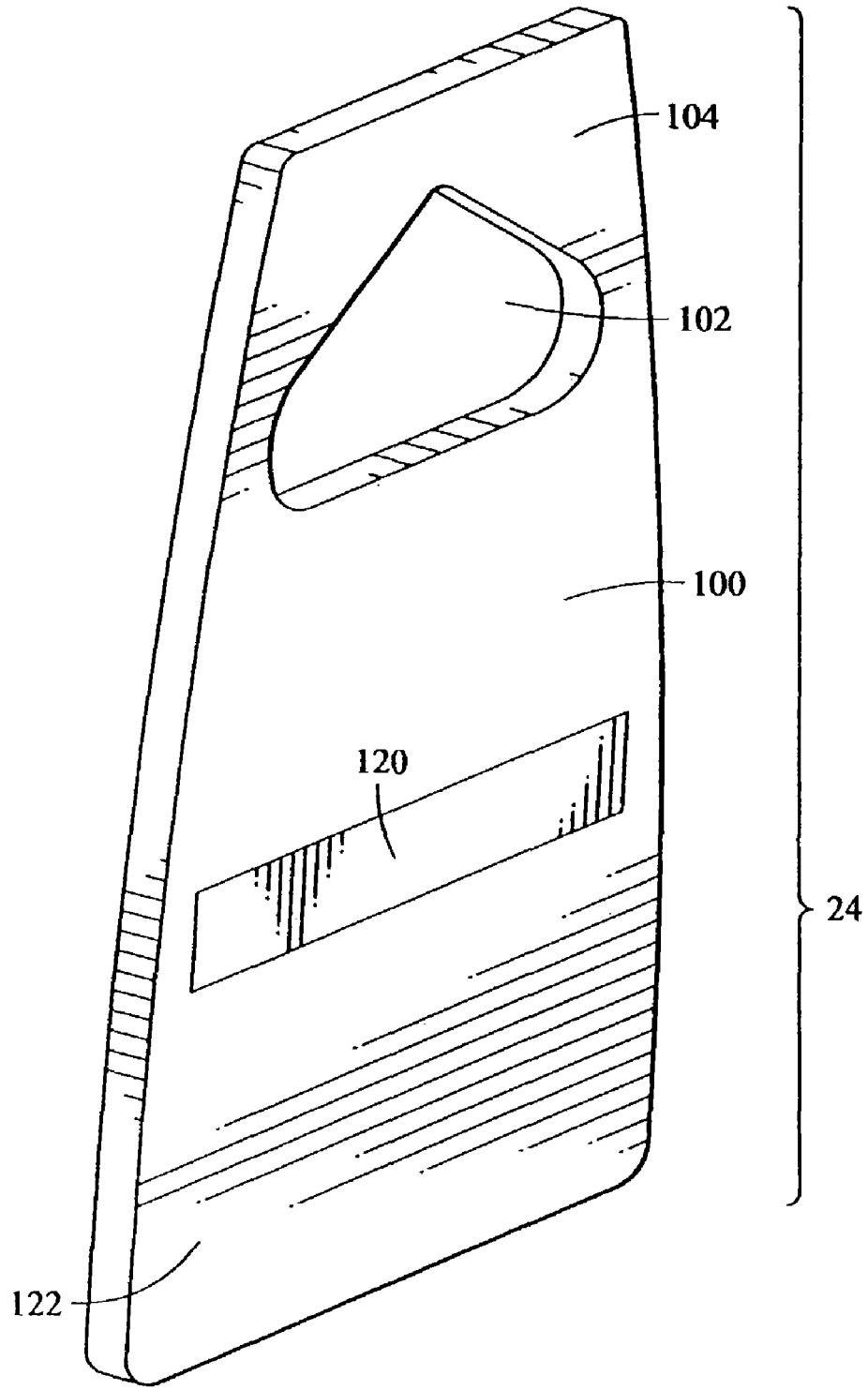
FIG. 7 shows a partial perspective rear view of the display tag of the container shown in FIG. 1 in accordance with the present invention.

FIG. 7 is a perspective, partial view of the rear side of the tag body 100 of the tag 24. As shown in the FIG. 7, a generally rectangular recess 120 is defined within the tag body 100. The recess 120 is sized to receive a rectangular anti-theft or sensor tag device within the recess so that the top surface of the sensor tag is generally flush with a rear planar surface 122 of the tag body 100. This allows a front surface 124 to be uniformly covered by a label or other means and provides a more uniform surface appearance pleasing to the consumer. Of course, the shape of the recess 120 may be modified in both depth, shape and placement to accommodate sensor tags of other shapes and configurations. In the preferred embodiment, the recess 120 is sized to receive an anti-theft strip label device such as that manufactured by Sensormatic® and available at http://www.sensormatic.com/eas www/Spec%20Sheets/labelmatrix.pdf. The anti-theft device functions when the tag 24 is in the "display" position or when the tag 24 is aligned with the body 20 or at any position on the 360° pivot. The display tag 24 may be mated to the body 20 so as to prevent the unauthorized removal of the tag 24 having the anti-theft device during display of the container 10 for retail sale. However, the mating of the tag 24 to the body 20 may allow the purchaser to remove the tag after purchase of the container 10 without destroying the container 10 and thereby allowing the user to have a smaller, more efficient storage container 10 for the items purchased.

A preferred embodiment of the container 10 may be molded from plastic using an injection mold, commonly known to one skilled in the art, to form the body 20, the lid 22 and the display tag 24. However, any material known in the art may be used to form the container 10 of the present invention. Additionally, in an embodiment of the present invention, the body 20 may be formed from polycarbonate and the lid 22 and the tag 24 formed from polypropylene. Alternatively, the container 10 may be formed from die cast aluminum. However, one skilled in the art will recognize that the container 10 or various components thereof may be formed from any material or combinations of materials capable of forming the container 10.

The container 10 may be used for housing a plurality of small tool accessories. Any tool accessory commonly known in the art may be housed in the container 10 for display and storage. In the preferred embodiment of the present invention, the tool accessories may be sized such that the container 10 holds a plurality of the tool accessories and the tool accessories may be easily dispensed from the container 10 through the opening 76. For example, the container 10 may be provided with and used to house tool bits, such as loose drill bits, that may be dispensed individually from the container 10 through the opening 76. Alternatively, the tool accessories may be accessed by removing the lid 22 from the body 20 and removing the items through the opening 40.

Although the invention herein has been described in connection with a preferred embodiment thereof, it will be appreciated by those skilled in the art that additions, modifications, substitutions, and deletions not specifically described may be made without departing from the spirit and scope of the invention as defined in the appended claims.

The invention claimed is:

1. A product storage and display container, said container comprising:

a receptacle defining a compartment adapted to house a product, the receptacle having a front and a back;

a display tag having a front face mountable to said receptacle and a slot adapted to receive a display hook for suspending the container at a product display;

an engagement element formed on one of said tag and said receptacle; and a receiving element formed on the other of said tag and said receptacle for receiving said engagement element such that said engagement element can rotate relative to said receiving element between a first position where the tag extends away from said receptacle and said tag is disposed with its front face generally toward said front and a second position where said front face is disposed behind said back;

wherein the mating of said engagement element with said receiving element retains said display tag on said receptacle.

2. The container of claim 1 wherein said engagement element is formed on said tag and said receiving element is formed on said receptacle.

3. The container of claim 1 wherein said engagement element is formed on said receptacle and said receiving element is formed on said tag.

4. The container of claim 1 wherein said receptacle further comprises a container body and a reclosable lid, wherein said lid is adapted to engage said body and enclose said compartment.

5. The container of claim 4 wherein said engagement element is formed on said tag and said receiving element is formed on said body.

6. The container of claim 1 wherein said receiving element further comprises a hole formed through the other of said tag and said receptacle.

7. The container of claim 1 wherein said engagement element further comprises at least one hook member.

8. The container of claim 7 wherein said at least one hook member further comprise a latching protrusion extending outwardly from each hook member.

9. The container of claim 4 wherein said lid further comprises an opening.

10. The container of claim 9 wherein said lid further comprises a tab closure to close said opening.

11. The container of claim 10 wherein said tab closure further comprises a snap-lock tab.

12. The container of claim 10 wherein said tab closure further comprises a living hinge connecting said tab to said lid.

13. The container of claim 1 wherein said lid further comprises an anti-theft cover.

14. The container of claim 1 wherein said display tag further comprises an anti-theft device.

15. The container of claim 1 wherein said display tag is removably engaged with said receptacle.

16. The container of claim 1 wherein said display tag further comprises a raised annular ring spacing the tag away from the receptacle.

17. The container of claim 1 wherein said product comprises a plurality of tool bits.

18. The container of claim 1 wherein said container further comprises a flip-top lid.

19. A product storage and display container, said container comprising:

a receptacle defining a compartment adapted to house a product, the receptacle having a front and an opening for allowing access to said product;

a display tag having a front face mountable to said receptacle;

an engagement element formed on one of said tag and said receptacle said engagement element including at least one hook member having a latching protrusion extending outwardly from said at least one hook member; and a receiving element comprising an aperture formed on the other of said tag and said receptacle for receiving said engagement element such that said engagement element can rotate relative to said receiving element between a display position where the tag extends away from said receptacle and said tag is disposed with its front face generally toward said front and a storage position where said tag is disposed behind said receptacle;

a sensor secured to said tag and a means for preventing access to said product through said opening.

20. The display configuration of claim 19 wherein said engagement element further comprises at least one hook member adapted to engage said receiving element.

21. The display configuration of claim 20 wherein said receiving element is an opening configured to receive at least one hook member.

22. The container of claim 19 wherein said means for preventing access includes an anti-theft cover over said opening.

23. The container of claim 22 wherein said cover is broken to allow access through said opening.

24. The container of claim 22 wherein a projection is formed between the display tag and the receptacle to allow the display tag to freely rotate relative to the receptacle.

25. A product storage and display container, said container comprising:

a receptacle defining a compartment adapted to house a product, the receptacle having a front and a back and an opening for allowing access to said product;

a display tag mountable to the receptacle and having a front face and a slot for receiving a display hook for suspending the container;

said front face including labeling information;

an engagement element formed on one of said tag and said back, said engagement element including at least one hook member having a latching protrusion extending outwardly from said at least one hook member; and a receiving element comprising an aperture formed on the other of said tag and said back for receiving said engagement element such that said engagement element can rotate around an axis perpendicular to said front face relative to said receiving element between a display position where the tag extends away from said receptacle and said tag is disposed with the front face facing generally toward said front and a storage position where said tag is disposed behind said receptacle with the front face facing generally toward said back.

26. The container of claim 1 wherein said tag is removably mounted to said container.

* * * * *